US005447590A

United States Patent [19]

Gilpatrick

[11] Patent Number: 5,447,590

[45] Date of Patent: Sep. 5, 1995

[54] METHOD TO PRODUCE LOOPED FABRIC WITH UPSTANDING LOOPS

[75] Inventor: Michael W. Gilpatrick, Chesnee, S.C.

[73] Assignee: Milliken Research Corporation, Spartanburg, S.C.

[21] Appl. No.: 74,681

[22] Filed: May 24, 1993

Related U.S. Application Data

[63] Continuation-in-part of Ser. No. 980,297, Nov. 23, 1992, abandoned.

[51] Int. Cl.[6] ..... B32B 29/02; B32B 3/06

[52] U.S. Cl. ..... 156/178; 156/148; 156/176; 156/66; 428/100; 24/445; 24/448; 28/212; 57/351

[58] Field of Search ..... 156/148, 178, 177, 176, 156/66; 428/100; 24/442, 445, 447, 448, 452, 444, 450; 28/212, 213, 253; 57/351

[56] References Cited

U.S. PATENT DOCUMENTS

| | | | |
|---|---|---|---|
| 2,246,776 | 6/1941 | Appleman | 28/212 X |
| 3,076,307 | 2/1963 | Marshall | 297/DIG. 6 X |
| 3,103,098 | 9/1963 | Dyer . | |
| 3,154,837 | 11/1964 | De Mestral . | |
| 3,266,841 | 8/1966 | Altman . | |
| 3,327,419 | 6/1967 | Stanos . | |
| 3,426,363 | 2/1969 | Girard . | |
| 3,522,637 | 8/1970 | Brumlik | 24/445 |
| 3,773,580 | 11/1973 | Provost | 24/448 X |
| 3,775,228 | 11/1973 | Leary . | |
| 3,863,304 | 2/1975 | Brumlik | 24/445 X |
| 3,913,183 | 10/1975 | Brumlik . | |
| 4,305,245 | 12/1981 | Eschenbach . | |
| 4,307,145 | 12/1981 | Goldman . | |
| 4,519,200 | 5/1985 | Phillips . | |
| 4,571,793 | 2/1986 | Price . | |
| 4,595,438 | 6/1986 | Kent . | |
| 4,761,318 | 8/1988 | Ott . | |
| 4,973,326 | 11/1990 | Wood et al. | 24/450 X |
| 4,994,504 | 2/1991 | Pigneul et al. | 428/100 X |
| 5,000,808 | 3/1991 | Deviney | 156/178 |
| 5,354,591 | 10/1994 | Ott et al. | 24/448 X |

FOREIGN PATENT DOCUMENTS

| | | | |
|---|---|---|---|
| 91611 | 8/1922 | Austria . | |
| 745805 | 8/1970 | Belgium | 156/148 |
| 2234415 | 1/1975 | France . | |

*Primary Examiner*—Jeff H. Aftergut

*Attorney, Agent, or Firm*—Terry T. Moyer; Earle R. Marden

[57] ABSTRACT

Method to produce a female fabric for use in a hook and loop connection in which the maximum number of loops are produced on the loop surface which engages the hooks of the mating hook fabric. The method includes mounting the reed at an obtuse angle to the loopy yarn used to cause the loops extending outwardly from the loopy yarn to be combed upwardly as it exits from the reed.

20 Claims, 3 Drawing Sheets

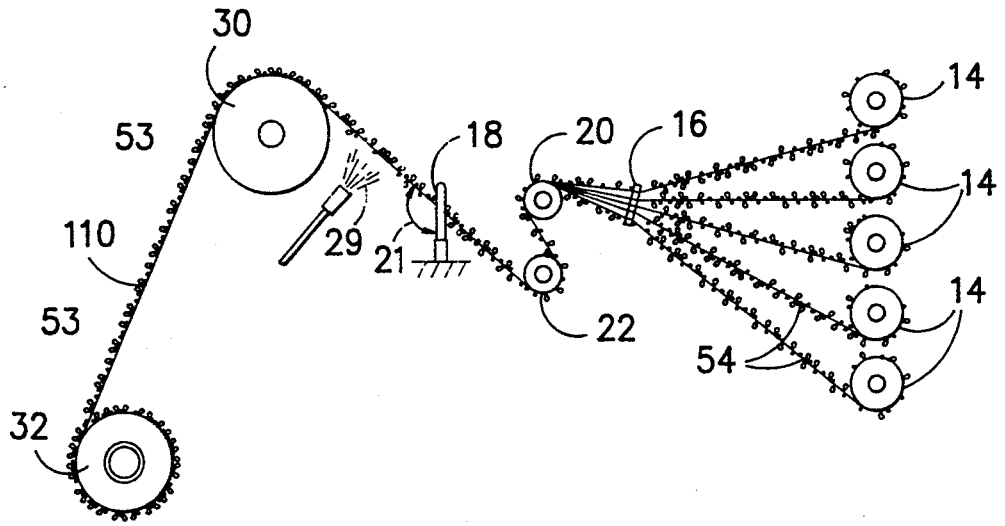
FIG. —3—
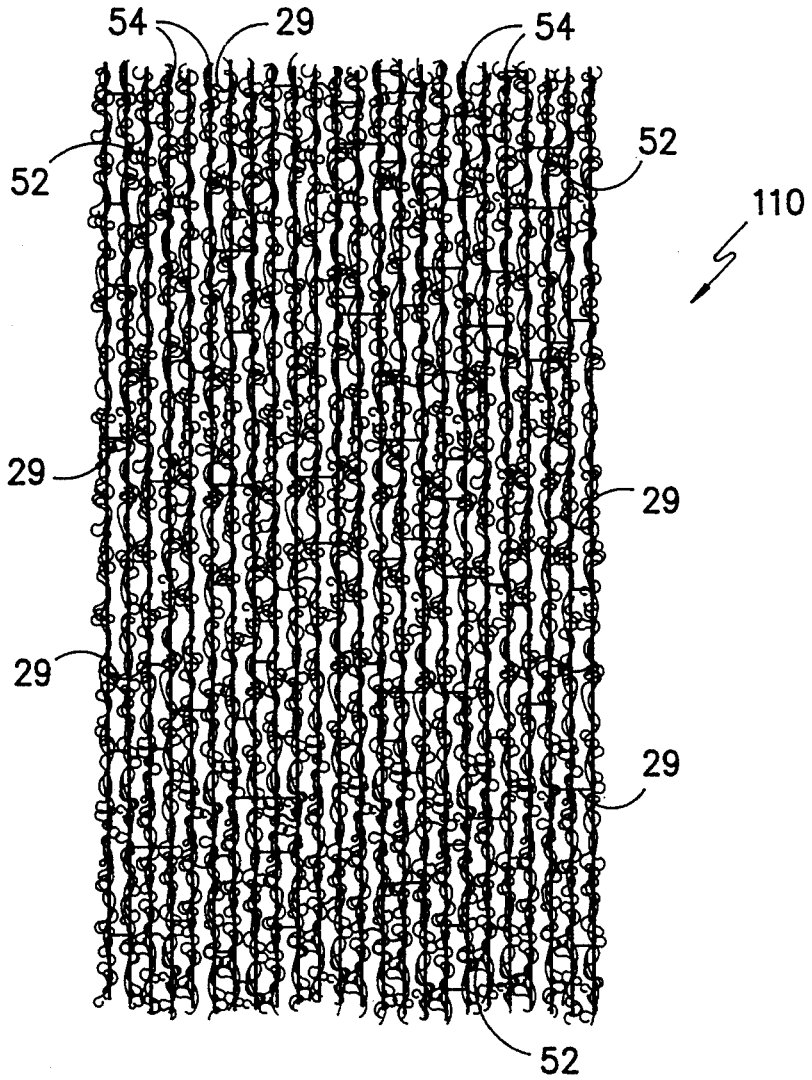
FIG. —4—

METHOD TO PRODUCE LOOPED FABRIC WITH UPSTANDING LOOPS

This application is a continuation-in-part application of prior application Ser. No. 07/980,297, filed on Nov. 23, 1992, now abandoned, of Michael William Gilpatrick for METHOD TO PRODUCE LOOPED FABRIC WITH UPSTANDING LOOPS.

This invention relates generally to a looped pile fabric and more specifically to a looped pile fabric which can be employed as the female fabric for receiving an article of manufacture in a pre-selected position in engagement with a male fabric which engages the loops of the loop pile fabric.

Therefore, it is an object of the invention to provide a loop pile fabric which is inexpensive to produce and which can be employed as a female fabric for engagement with a male connector.

Other objects and advantages of the invention will become readily apparent as the specification proceeds to describe the invention with reference to the accompanying drawings, in which:

FIG. 3 is a schematic representation of a modified method to make the fabric shown in FIG. 4;

FIG. 4 is a top view of the fabric produced by the apparatus of FIG. 3;

Figure 1:
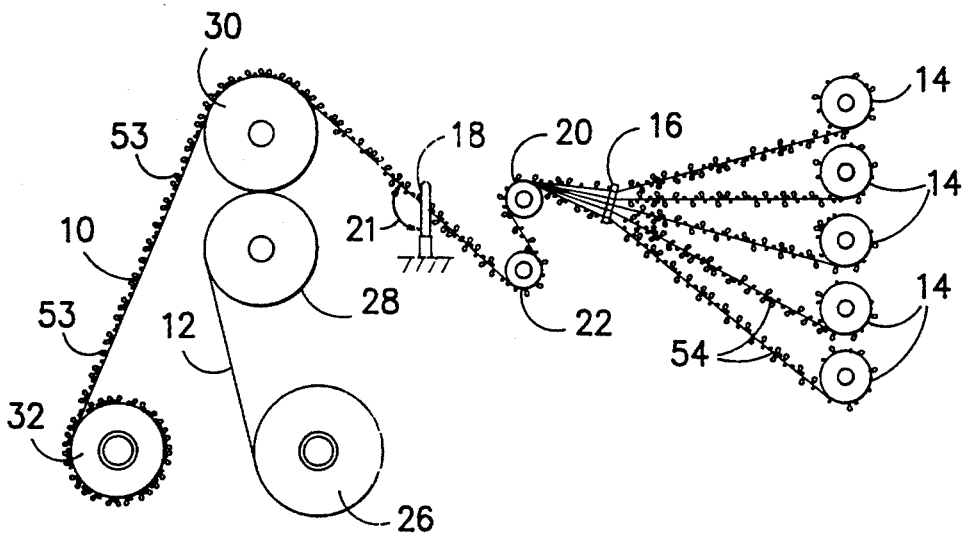
FIG. 1 is a schematic representation of the method of making the fabric shown in FIG. 2.
Figure 2:
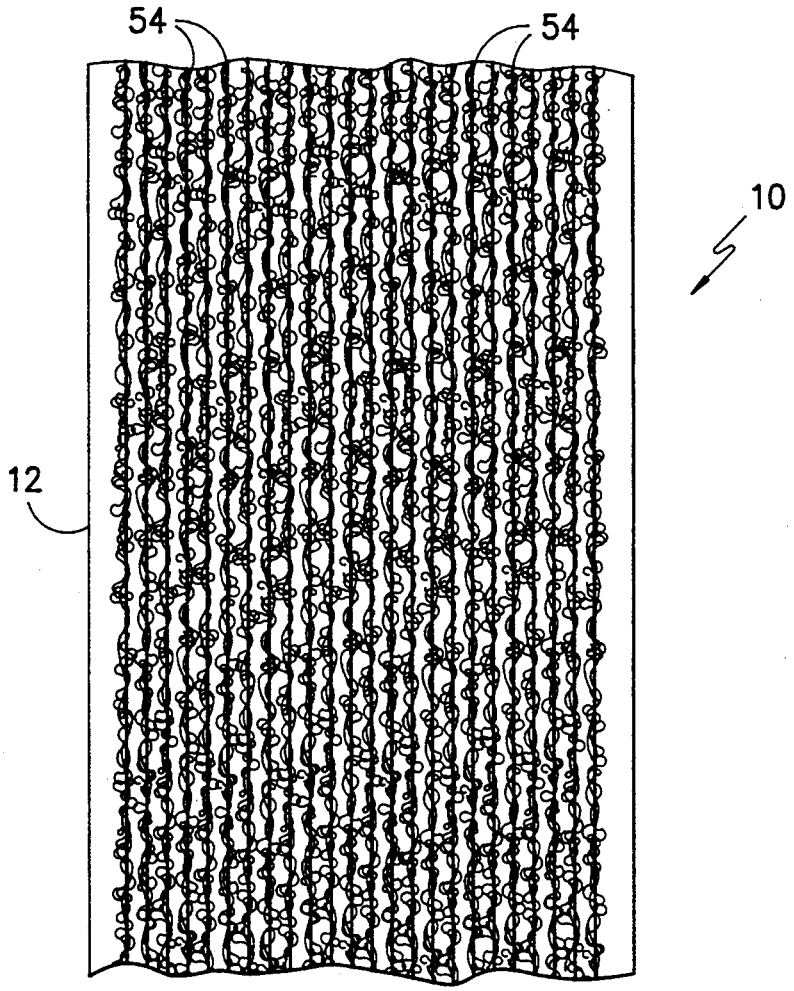
FIG. 2 is a top view of the fabric produced by the apparatus of FIG. 1.
Figure 5:
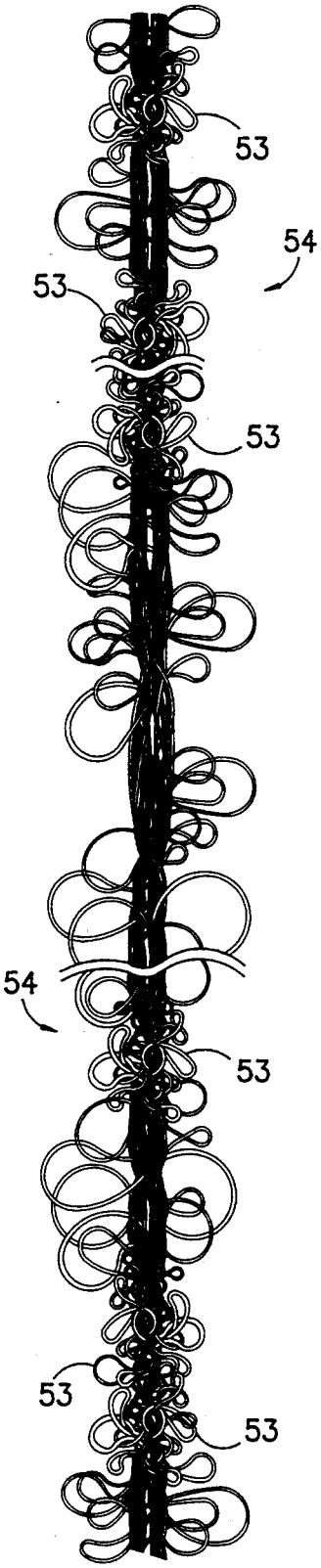
FIG. 5 is a view of one type of loop yarn used in the fabrics of FIGS. 2 and 4.

Looking now to the drawings, FIG. 2 shows a female fabric 10 produced by the method shown in FIG. 1. Basically the fabric 10 consists of a paper substrate 12 having a coating of adhesive thereon in which a plurality of substantially parallel yarns 54 are imbedded. In the preferred form of the invention the yarn 54 (FIG. 5) consists of a core yarn and an effect yarn which provide the loops 53. The core and effect yarns are 255 denier, 34 filament polyester p.o.y. yarns which are drawn to 155 denier and then supplied to a texturing air jet with the effect yarn being supplied at a rate substantially greater than the core yarn to produce a composite yarn having loops 53 of the effect yarn projecting therefrom. Within the scope of the invention other yarns can be employed so long as the yarn has a sufficient number of loops projecting therefrom to provide a secure engagement with a mating male fabric.

The yarns 54 are taken up on bobbins or packages 14 (FIG. 1) and mounted in a creel (not shown). Depending on the width of the fabric 10 a sufficient number of packages 14 are employed to lay down 16 or other desired number of yarns 54 per inch of width of fabric 10. The yarns 54 are supplied from the bobbins 14 through a perforated guide plate 16 to maintain each separate from the other prior to delivery to the reed 18 over pull rolls 20 and 22. The paper web 12 with a 1 mil coating of a thermoplastic adhesive such as polyethylene from the roll 26 is heated to approximately 390° F. to cause the adhesive to become tacky. The paper web 12 is directed into contact with the yarns 54 by the roll 28 and heated roll 30 at a rate of approximately one yard per minute. From the roll 30 the female fabric is directed to the take-up roll 32 at a sufficient distance from the rolls 28 and 30 to allow the adhesive to cool and set to retain the yarns 54 in the desired substantially parallel position.

In the modified form of the invention shown in FIGS. 3 and 4, FIG. 4 shows the female fabric 110 produced by the method shown in FIG. 3. Basically the fabric 110 consists of a plurality of the substantially parallel loopy yarns 54 held in spaced relationship by adhesive coated loops 53 on one yarn 54 adhering to loops 53 on adjacent yarns such as at 52 and/or adhesive 29, per se, bridging adjacent yarns 54. Whether the fabric 10 consists of adhered loops, adhesive bridging or a combination of both depends on the type of adhesive and method employed to apply the adhesive.

In the modified form of the invention the yarn 54 consists of a core yarn and an effect yarn which provide the loops 53. The core and effect yarns are 255 denier, 34 filament polyester p.o.y. yarns which are drawn to 150 denier and then supplied to a texturing air jet with the effect yarn being supplied at a rate substantially greater than the core yarn to produce a composite yarn having loops 53 of the effect yarn projecting therefrom. Within the scope of the invention other yarns can be employed so long as the yarn has a sufficient number of loops projecting therefrom to provide a secure engagement with a mating male fabric.

The yarns 54 are taken up on bobbins or packages 14 (FIG. 3) and mounted in a creel (not shown). Depending on the width of the fabric 110 a sufficient number of packages 14 are employed to lay down the desired number of yarns 54 per inch of width of fabric 110. The yarns 54 are supplied from the bobbins 14 through a perforated guide plate 16 to maintain each separate from the other prior to delivery to the reed 18 over guide rolls 20 and 22. From the reed 18 the yarn sheet consisting of yarns 54 has an adhesive 29 applied thereto prior to passing over the roll 30, for example, by a reciprocating adhesive spray application 29. From the roll 30 the female fabric is directed to the take-up roll 32 at a sufficient distance from the rolls 28 and 30 to allow the adhesive to set to retain the yarns 54 in the desired substantially parallel position.

In this form of the invention a PVA water base emulsion adhesive can be used so it is necessary to heat the roll 30 to aid in heat setting the adhesive sprayed onto the sheet of yarns 54. Other adhesives that can be used with a hot roll 30 are polyethylene or other water based emulsions or solutions of acrylic, styrene butadiene or polyurethane. It is also feasible to use a cold roll 30 along with a hot melt adhesive of polyethylene, polyester, polyamide, polyurethane, etc. which are set by cooling rather than heat.

Other types of adhesive applicators such as a kiss roll can be employed in place of the spray so long as a thin layer of adhesive is applied to the yarn sheet sufficient to hold the yarns 54 in spaced relationship to one another when the adhesive is set.

It should be noted that in both forms of the invention the yarn sheet passes over the roll 30 and then downward to cause the loops on one side of the yarn sheet to be mashed one against the other to aid in maintaining the spaced relationship of the yarns 54 when the adhesive has set, while the loops on the other side of the yarn sheet are undisturbed.

Figure 6:
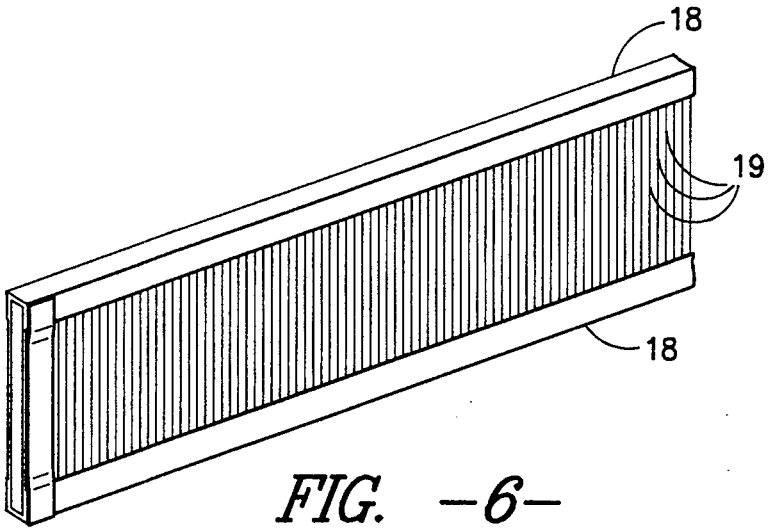
FIG. 6 is one type of reed used to make the fabrics of FIGS. 2 and 4.

In both forms of the invention the angle 21 between the output side of the dent 18 and the yarn 10 is an obtuse angle, i.e., greater than 90° , preferably 120°–150° . This angle combined with the spacing between the dents 19 of the reed 18 (FIG. 6) combs the outwardly extending loops 53 of the yarn upwardly since the spacing between the dents 19 is greater than the diameter of the straight sections of the yarn 52 but less than the distance of the radius of a circle around the outermost extending loops 53. As shown downstream of the roll 30 (FIGS. 1 and 3) a maximum number of loops are projecting upwardly from the surface of the produced fabric 10 as described in both forms of the invention the greater rate of supply of the effect yarn is in the range of 100–200% of the rate of the core yarn and is preferably about 150%.

As hereinbefore explained, methods of producing a female type fabric for use with a male type fabric in a hook and loop connection have been explained. Such methods produce a fabric which the maximum number of loops are provided on the hook engagement surface of the produced loopy fabric so that a secure connection will be made with a hook type fabric.

It is contemplated that changes and modifications may be made within the scope of the invention and it is therefore requested that the disclosed invention be limited only by the scope of the claims.

I claim:

1. A method of producing a fabric with loops projecting upwardly therefrom comprising the steps of: sequentially supplying a sheet of yarns with each yarn in the sheet having a plurality of loops projecting outwardly and upwardly therefrom, treating the sheet of yarns to cause the outwardly projecting loops to be combed upwardly, treating the sheet of yarns to form a fabric with the yarns in a fixed spatial relationship and taking up the formed fabric.

2. The method of claim 1 wherein the plurality of yarns in the sheet are placed thereon substantially parallel to one another.

3. The method of claim 1 wherein the yarn with loops therein are core and effect yarns and the effect yarns have been overfed in relation to the core yarns during formation of the yarn to cause loops to form therein.

4. The method of claim 3 wherein the plurality of yarns in the sheet is placed thereon substantially parallel to one another.

5. The method of claim 1 wherein the yarns are treated to cause the loops to be combed upwardly by running the yarns through a reed, the reed having spaces therein narrower than the maximum diameter of the yarn running through the space in the reed.

6. The method of claim 5 wherein the reed is mounted so that the output side of the reed forms an obtuse angle with yarn exiting from the reed.

7. The method of claim 6 wherein the obtuse angle is in the range of 120°–150°.

8. A method of producing a fabric with loops projecting outwardly therefrom comprising the steps of: sequentially supplying a plurality of yarns with loops projecting outwardly and upwardly therefrom, running the yarns through a reed to comb the outwardly projecting yarns into an upward position, running the plurality of yarns after combing in a sheet past an adhesive applicator, placing a layer of adhesive on the sheet of yarn, setting the adhesive on said yarn to maintain the yarns in the sheet in a fixed spatial relationship and taking up the sheet of yarn after the adhesive has set.

9. The method of claim 8 wherein the reed is mounted so that the output side of the reed forms an obtuse angle with yarn exiting from the reed.

10. The method of claim 9 wherein the obtuse angle is in the range of 120°–150°.

11. The method of claim 9 wherein the plurality of yarns in the sheet are placed thereon substantially parallel to one another.

12. The method of claim 9 wherein the yarn with loops therein are core and effect yarns and the effect yarns have been overfed in relation to the core yarns during formation of the yarn to cause loops to form therein.

13. The method of claim 12 wherein the plurality of yarns in the sheet is placed thereon substantially parallel to one another.

14. The method of producing a fabric with loops projecting therefrom comprising the steps of: sequentially supplying a plurality of yarns each with loops projecting upwardly and outwardly therefrom, supplying a web of material with adhesive thereon, treating the plurality of yarns to comb the outwardly extending loops to an upward position and laying the plurality of yarns into the adhesive on said material so that the upwardly extending loops in said yarns are not deformed and taking up the web of material after the adhesive has cured.

15. The method of claim 14 wherein the yarns are treated by running them through a reed.

16. The method of claim 15 wherein the reed is mounted so that the output side of the reed forms an obtuse angle with yarn exiting from the reed.

17. The method of claim 16 wherein the obtuse angle is in the range of 120°–150°.

18. The method of claim 16 wherein said yarns are layed in substantially parallel to one another.

19. The method of claim 16 wherein the web of material is paper.

20. The method of claim 19 wherein the web of paper is heated to make the adhesive on the paper tacky prior to laying the yarns thereon and allowing the adhesive to cool after laying the yarns thereon to set the yarns into position on said paper.

* * * * *